United States Patent [19]

Redman

[11] 4,409,769

[45] Oct. 18, 1983

[54] HEAT INSULATED ENTRANCE

[75] Inventor: Ronald E. Redman, Niles, Mich.

[73] Assignee: Kawneer Company, Inc., Niles, Mich.

[21] Appl. No.: 180,624

[22] Filed: Aug. 25, 1980

[51] Int. Cl.[3] ..... E04B 5/52

[52] U.S. Cl. ..... 52/475; 52/730; 52/741; 49/DIG. 1

[58] Field of Search ..... 52/475, 730, 731, 732, 52/741; 49/DIG. 1

[56] References Cited

U.S. PATENT DOCUMENTS

| | | | |
|---|---|---|---|
| 2,933,779 | 4/1960 | Delaroche . | |
| 2,985,263 | 5/1961 | Maciunas . | |
| 3,099,337 | 7/1963 | Hetman . | |
| 3,203,053 | 8/1965 | Lane et al. . | |
| 3,204,324 | 9/1965 | Nilsen . | |
| 3,267,629 | 8/1966 | Waring et al. . | |
| 3,289,377 | 12/1966 | Hetman . | |
| 3,332,184 | 7/1967 | McEvoy | 52/731 X |
| 3,335,524 | 8/1967 | Carson | 52/731 X |
| 3,348,349 | 10/1967 | Petersen | 52/731 X |
| 3,353,301 | 11/1967 | Heilweil et al. | 52/731 X |
| 3,527,011 | 9/1970 | Bloom et al. . | |
| 3,555,735 | 1/1971 | Weikert | 49/501 |
| 3,624,885 | 12/1971 | Holliday et al. . | |
| 3,818,666 | 6/1974 | Winans . | |
| 3,861,085 | 1/1975 | Jacob | 49/501 |
| 3,975,881 | 8/1976 | Ninowski, Jr. . | |
| 3,978,629 | 9/1976 | Echols, Sr. | 52/730 X |
| 4,067,163 | 1/1978 | Hetman . | |
| 4,096,678 | 6/1978 | Diels et al. | 49/DIG. 1 X |
| 4,118,266 | 10/1978 | Kerr . | |
| 4,120,127 | 10/1978 | Hubbard . | |
| 4,128,934 | 12/1978 | Doring . | |
| 4,164,830 | 8/1979 | Bierlich . | |
| 4,187,657 | 2/1980 | Sukolics . | |
| 4,207,717 | 6/1980 | Hubbard . | |

*Primary Examiner*—Carl D. Friedman

*Attorney, Agent, or Firm*—Mason, Kolehmainen, Rathburn & Wyss

[57] ABSTRACT

A heat insulated entrance includes a door/window having a frame comprising an elongated, tubular, metal member having an inside wall and a wall transverse thereto with a rib formed adjacent a corner at the intersection of the walls. An elongated metal cladding member having a generally channel shaped transverse cross section with a web forming an inside wall face of the door/window and a pair of edge flanges transverse thereto is secured in place on the tubular metal member by a spacer formed of heat insulating material and having one edge in supported engagement with the rib of the tubular frame member. The cladding member has an opposite edge in keyed interengaging relation with an opposite edge of the spacer to complete an insulated frame member assembly having a thermally insulating spacer element between a pair of inside and outside metal portions. The door/window is useful in combination with a heat insulating wall frame system providing a jamb surface, header and sill forming an opening in which the door/window is mounted. The invention also encompasses the conversion of existing, non-insulating type doors/windows into more efficient, heat insulating type, closure members by the addition of insulating spacers and inside metal cladding members in accordance with the invention.

30 Claims, 4 Drawing Figures

HEAT INSULATED ENTRANCE

BACKGROUND OF THE INVENTION

1. Field of the Invention

The present invention relates to insulated entrance systems for buildings and more particularly to a door/-window having a heat insulating frame member comprising a pair of inside and outside metal members interconnected by a heat insulating spacer therebetween. A door/window or closure member of the invention is also useful in combination with a heat insulating type wall frame system forming an entrance opening in which the door/window is mounted. In addition, the invention also encompasses the conversion of existing non-insulating type closure members into more heat efficient members by the application of heat insulating spacers and metal cladding elements thereto to provide thermally efficient windows and doors for building walls and entrances.

2. Description of the Prior Art

With the advent of the energy crisis and ever increasing fuel costs, many different types of heat insulating building walls, doors, windows and entrances have been proposed. The following U.S. Pat. Nos. disclose efforts in this area to provide more heat efficient structures and are listed as follows: 2,933,779; 2,985,263; 3,099,337; 3,203,053; 3,204,324; 3,267,629; 3,335,524; 3,527,011; 3,624,885; 3,818,666; 3,861,085; 3,975,881; 3,978,629; 4,067,163; 4,118,266; 4,128,934; 4,164,830; and 4,187,657.

Ojects of the Invention

It is an object of the present invention to provide a new and improved heat insulating frame member for buildings and the like and more particularly it is an object to provide a new and improved door/window having greatly improved heat insulating characteristics in comparison to conventional non-insulated units.

It is yet another object of the present invention to provide a new and improved, heat insulated entrance system for buildings and the like and more particularly an entrance system having a door/window or other closure member with a frame having frame members formed of a pair of inside and outside metal elements interconnected by a spacer of heat insulating material to form a continuous thermal break between the inside and outside portions.

Yet another object of the present invention is to provide a new and improved entrance door/window having a heat insulating frame for supporting a heat insulating type, dual pane, glazing panel therein.

Still another object of the present invention is to provide a new and improved building entrance including a heat insulating door/window of the character described which is mounted in a surrounding framed opening formed of heat insulating frame members and providing a continuous thermal break or barrier between inside and outside portions of the door and the surrounding frame.

Yet another object of the present invention is to provide a new and improved system for converting existing non-insulating frame members, of doors/windows, etc. into more thermally efficient units in a fast, economical and relatively simple conversion.

SUMMARY OF THE INVENTION

The foregoing and other objects and advantages of the present invention are accomplished in a new and improved door/window having a frame member comprising an elongated tubular metal element including an inside wall and a wall transverse thereto with a rib formed adjacent a corner at the intersection of the walls. An elongated metal cladding element of generally channel-shaped transverse cross section is provided with a web which forms an inside wall face of the door/window and a pair of edge flanges transverse to the web extend outwardly thereof. A spacer of heat insulating material is mounted between the tubular metal element and the metal cladding member to provide a heat insulating, spaced apart relation therebetween. One of the flanges of the cladding member is in supported, keyed, interlocked engagement with an edge of the spacer and an opposite edge of the spacer is in supported interlocked engagement with the rib on the tubular frame element.

The door/window provides a continuous heat insulating barrier or thermal break between the inside and outside metal elements and is especially useful in combination with a heat insulating type, surrounding framework or building wall structure. The spacer and cladding system is useful in the conversion of existing noninsulated doors/windows with heat insulating more thermally efficient units.

BRIEF DESCRIPTION OF THE DRAWINGS

For better understanding of the present invention reference should be had to the following detailed description taken in conjunction with the drawings, in which.

BRIEF DESCRIPTION OF THE DRAWINGS

Figure 1:
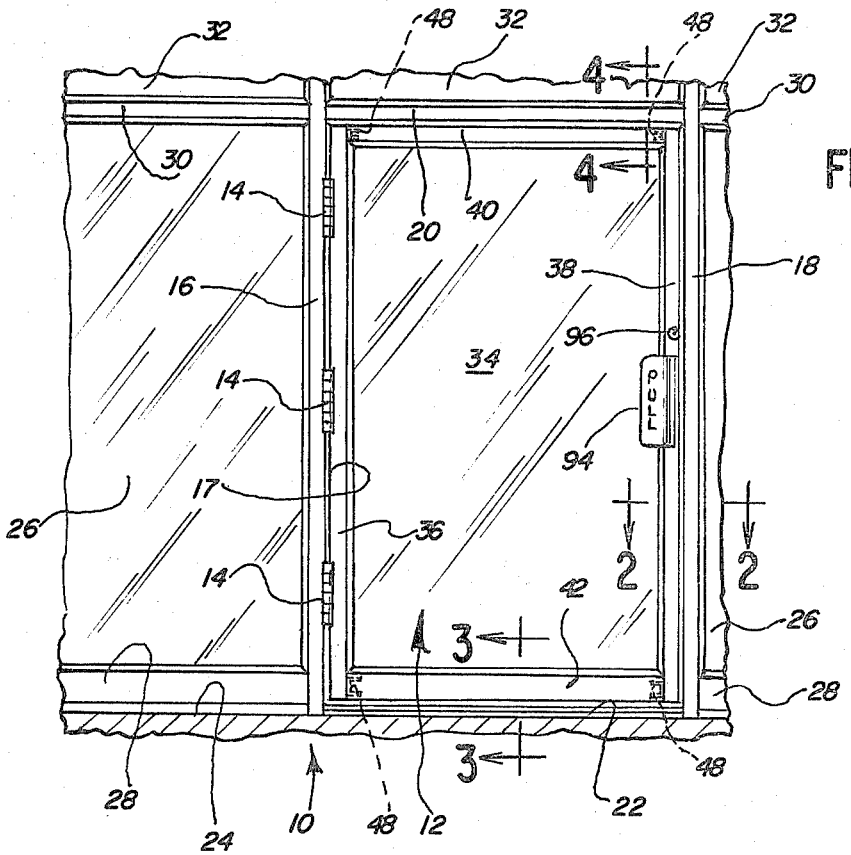
FIG. 1 is an outside, elevational view of a new and improved heat insulating entrance system for buildings and the like constructed in accordance with the features of the present invention.

Referring now more particularly to the drawings, therein is illustrated a new and improved heat insulating entrance system for building walls and the like constructed in accordance with the features of the present invention and referred to generally by the reference numeral 10. The entrance system includes a glass or other type of insulating panel door 12 constructed in accordance with the features of the present invention and supported for swinging movement on a plurality of hinges 14 which are mounted on a vertically extending, mullion or jamb member 16 which forms one side of a rectangular entrance opening 17. On the opposite side, the opening is framed by another vertical mullion or jamb member 18 and a transom or header 20 is provided adjacent the upper edge of the door to extend between the vertical mullions. At the bottom of the entrance opening, a metal threshold 22 extends between the mullions 16 and 18 and is mounted on the upper surface of the building floor 24.

The lock stile 38 of the door is provided with a convenient door pull or handle 94 and a lock 96 which may be key operated to interact with the strike plate or slot formed in the filler element 80 of the jamb surface of the door frame mullion 18.

On either side of the entrance opening 17, the building wall structure may include rectangular dual glazing panels 26 supported along vertical edges by the mullions 16 and 18 and similar mullions (not shown) at spaced intervals therefrom. Lower edges of these glazing panels may be supported by sill members 28 and upper edges of the panels are secured by horizontal mullions 30 similar to the mullion of header 20 above the entrance opening. Additional glazing panels 32 may be provided above the horizontal mullion 30 and the header 20 depending upon the architecture of the building involved. Preferably all of the horizontal and vertical frame members of the building wall structure are of the heat insulating type which employ inside and outside metal elements separated and maintained in heat insulating, but structurally interconnected relation with respect to one another by spacers and/or interlocking elements formed of heat insulating material as will be described in more detail in connection with the vertical mullions 16 and 18 and the header 20 which frame the door opening 17.

Figure 2:
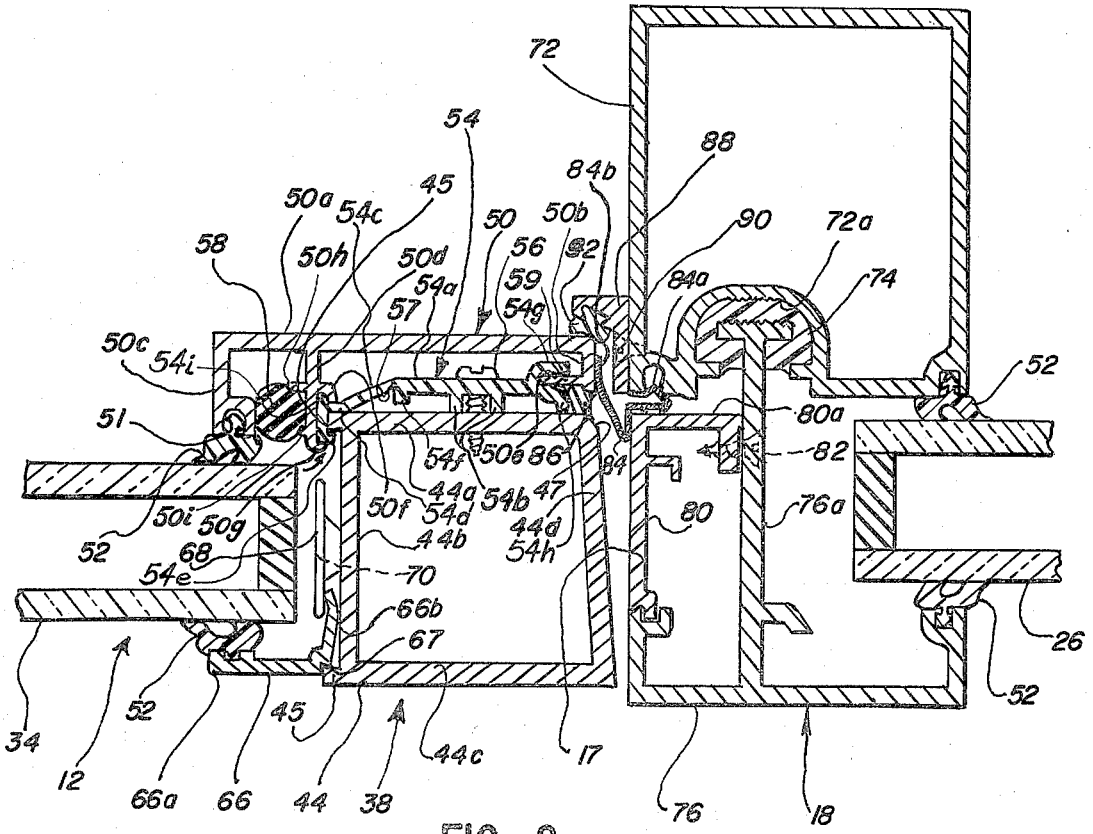
FIG. 2 is an enlarged, fragmentary horizontal cross sectional view taken substantially along lines 2—2 of FIG. 1.

The door 12 is of a heat insulating type and includes a rectangular, dual pane, heat insulating type glazing panel 34 which is supported in a rectangular framework comprising a vertical hinge stile 36, a parallel lock stile 38, a header rail 40 extending between the door stiles and a lower or sill rail 42 forming the base of the door framework. In accordance with the present invention, the vertical stiles 36 and 38 include an outside metal element preferably of extruded aluminum and formed with a transverse cross section of tubular, generally trapezoidal shape as illustrated in FIG. 2 and referred to generally by the reference numeral 44. Preferably the outside metal tubular members 44 of the hinge and lock stiles are of identical transverse cross section as shown and are cut from lengths of extrusion stock to provide the desired dimensional parameters for a door of a particular size. The header rail 40 and the lower rail 42 include a slightly larger outside metal member 46 formed of extruded aluminum and having a generally rectangular shaped, tubular transverse cross-section with a pair of inner and outer wall faces forming a downwardly facing, contiguous channel shaped transverse cross section on the lower edge portion of the lower rail as shown in FIG. 3 and an upwardly facing channel-shaped cross-section on the upper edge portion of the header rail as shown in FIG. 4.

Each outside metal member 44 of the hinge and lock stiles is formed with an inside wall face **44*a* and an inner transverse wall section 44*b* at right angles thereto. At the inside corner or junction of the walls 44*a* and 44*b*, the extrusion is formed with a projecting rib of trapezoidal shaped transverse cross section as indicated by the reference numeral 45. The rib extends outwardly of the transverse wall 44*b* and has one edge face coextensive with the inside face of the wall 44*a*. The metal members 44 also include an outer wall face 44*c* parallel of the inside wall 44*a* and a second, slanted, transverse wall 44*d* facing outwardly towards an adjacent wall framing member of the entrance opening 17**.

As illustrated in FIG. 2, the second transverse wall **44*d* is slightly out of parallel with respect to the opposite or first transverse wall 44*b* and the corner or junction between the wall sections 44*a* and 44*d* is smoothly rounded as at 47 to provide a rounded corner. A rib 45 of trapezoidal shaped transverse cross section is also formed at the outside corner of the frame members 44 between the outside wall 44*c* and the first transverse wall 44*b*** as illustrated.

Figures 3, 4:
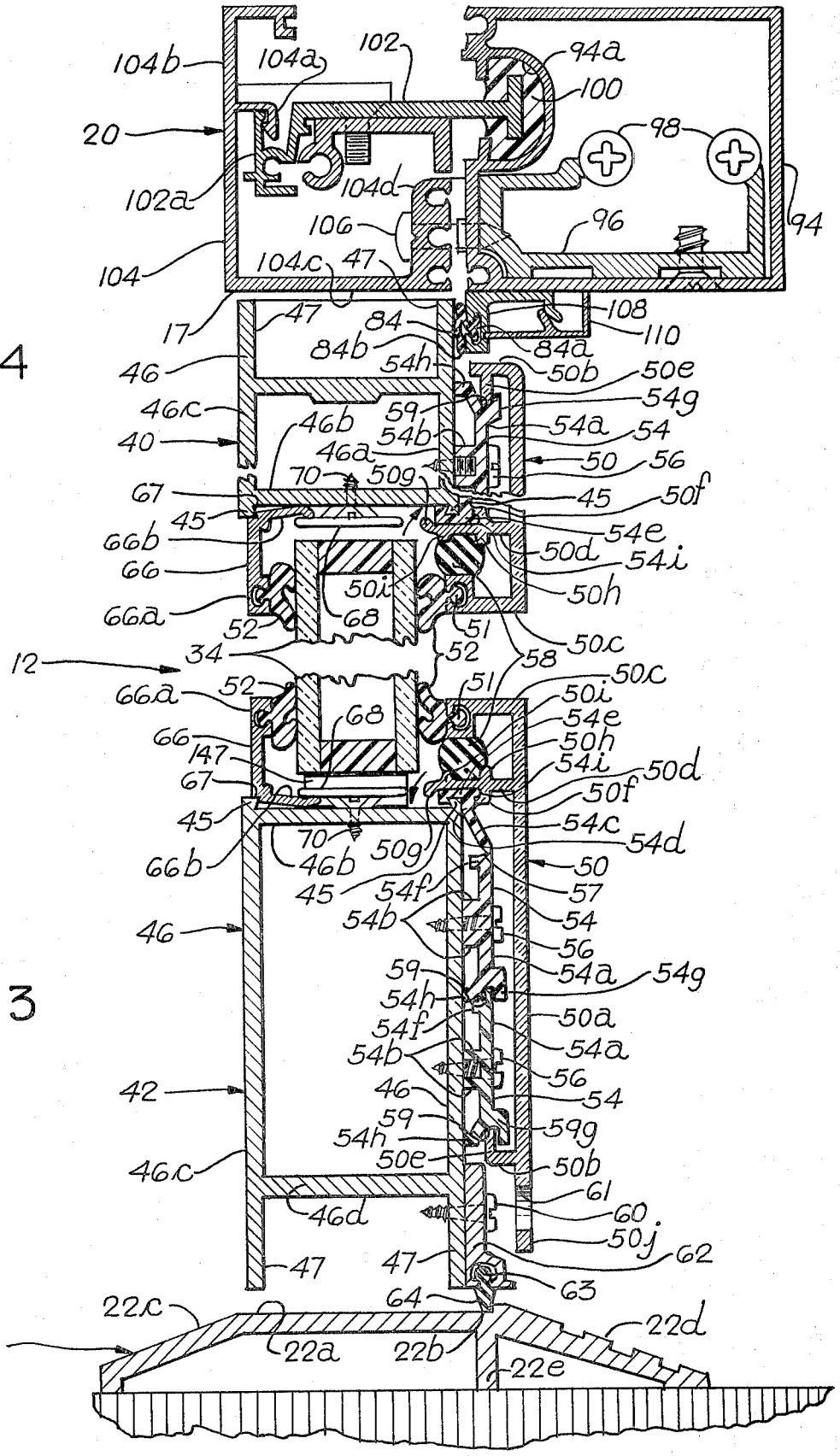
FIG. 3 is an enlarged, transverse cross sectional view taken substantially along lines 3—3 of FIG. 1.
FIG. 4 is an enlarged, vertical, cross sectional view taken substantially along lines 4—4 of FIG. 1.

Referring to FIGS. 3 and 4, the outside, metal rail member 46 is formed with a relatively wide inside wall section **46*a* and a pair of wall section 46*b* and 46*d* transverse thereto. An outside wall face 46*c* is parallel of the inside face 46*a* and portions 47 of the inside and outside walls project beyond the transverse wall section 46*b* to form the channel-shaped portion of the rail. At the junction of the transverse wall 46*b* and the inside and the outside wall sections 46*a* and 46*c*, respectively, a pair of ribs 45 of trapezoidal-shaped, transverse cross section are formed similar to the ribs 45 on the frame members 44**.

The vertical stiles 36 and 38 and the horizontal rails 40 and 42 are interconnected at the corners of the door with ends of the rails butt-fitted against the inside walls **44*b* of the stiles. The corners of the frame of the door are strengthened by means of internal channels 48 which are bolted, welded or otherwise secured to the intersecting inside transverse wall elements 44*b* of the respective stiles and rails to form a rigid rectangular framework for supporting the relatively heavy insulating glass panel 34 in the central opening thereof. Preferably, the glass panel is supported by the door frame in the opening 17** with support elements (not shown) like those shown in U.S. Pat. No. 2,610,369, which patent is incorporated herein by reference.

In accordance with the present invention, the inside face portions of the door frame is provided with a covering comprising elongated metal cladding elements 50 of generally channel shaped, transverse cross section which include a main base or web portion **50*a* forming an inside face member for the door 12 when installed on the stiles and rails. It should be noted from FIG. 3 that the cladding element 50 utilized on the wider door rails 40 and 42 is provided with an inside face member 50*a* having an increased width with respect to the other stiles in order to match the larger vertical transverse dimension of the outside metal element 46** of the lower rail.

Each channel shaped cladding element 50 includes an outside edge flange **50*b* extending toward the inside wall portion 44*a* or 46*a* of an outside tubular element of the door frame and along the opposite edge, the cladding elements include an inside edge flange 50*c* transverse to the web and extending toward a marginal edge portion on the inside surface of the glass panel 34. Preferably the cladding element 50 is formed of an aluminum extrusion and is provided with an intermediate tongue-like flange or leg 50*d* spaced between the outside edge flanges and extending generally normal to the web 50*a*** towards the outside surface of the door.

It should be noted that when the cladding members 50 are secured in place on the stiles and rails of the door, the web portions **50*a* project beyond the ribs 45 on the outside metal elements 44 and 46, respectively, in order that the inside edge flange 50*c* on each cladding element may function as a glass stop for supporting an inside face of the glazing panel 34 around the marginal edge thereof. For this purpose, along the outwardly facing edge, the edge flange 50*c* is formed with an enlarged or thickened rib portion having an outwardly facing groove 51 defined therein. In the groove is mounted a tongue portion of a resilient sealing strip 52 formed of extruded plastic material and adapted to sealingly bear against the inside face of the glazing panel 34**.

Glazing strips of similar cross section and composition are also provided to seal against the outer surface of the door glazing panel 34 as well as the fixed glazing panels 26 and 32 in the building wall as shown in FIGS. 2, 3 and 4. Thus, each of the glazing panels in the wall and the door is resiliently sealed around the perimeter thereof with respect to the surrounding and supporting metal framework of the building wall or the frame of the door, as the case may be.

In accordance with the present invention, a heat insulating, spaced apart relation is established to form a thermal barrier or break between the outside tubular metal frame elements 44 and 46 of the door 12 and the inside metal cladding strips 50. This thermal barrier is provided by elongated spacers 54 formed of heat insulating, plastic material and having a unique, transverse cross-sectional shape as shown in the sectional views of FIGS. 2, 3 and 4. Preferably, the spacers are continuous and run the length of the respective metal tubular frame members 44 and 46 of the door frame. However, short lengths of the spacers positioned at spaced apart, appropriate intervals as required for strength may be substituted. Preferably, the spacer strips 54 are formed of extruded plastic material of a high strength type and having a relatively low, coefficient of heat conduction so that an excellent thermal barrier is maintained between the outer, metal tubular members 44 and 46 and the inside, metal cladding elements 50.

As illustrated in FIGS. 2, 3 and 4, the spacer strips 54 are of a unique transverse cross sectional profile and include a main or central web or base portion **54*a* which is in spaced apart parallel relation between the web 50*a* of the cladding element 50 and the inside wall 44*a* or 46*a* of the outer metal members 44 and 46, respectively. This spacing is set up by a pair of intermediate transverse ribs 54*b*. At suitable intervals along the length of the spacers, self-tapping sheet metal type screws 56 are utilized to secure the main body portion of the spacer in place on the walls 44*a* and 46*a*** as illustrated.

Along the inside edge portion, the spacer strips are formed with an inwardly sloping segment **54*c* terminating in an edge portion 54*d* having a face adapted to abut the inside surface of the walls 44*a* and 46*a*. Along an outer edge, the portion 54*d* of the spacer is provided with a J-shaped rib 54*e* which is adapted to interlock in hooked engaged relationship with the corner rib 45 of trapezoidal-shaped cross section on the outer metal tubular members 44 and 46. The hooked interlocking relation between the edge rib 54*e* of the spacer and the rib 45 of the metal elements provides an easy means for attaching and holding the spacer in position on the tubular metal members until the fasteners 56** are installed to permanently and rigidly secure the spacer in place.

Referring to FIGS. 3 and 4, on the rails 40 and 42 of the door, the inside wall segment **46*a* of the tubular member 46 is relatively wide and two or more spacers 54 may be required to support the cladding member 50 of correspondingly increased width. A first spacer 54 is mounted with its J-shaped, hooked edge flange 54*e* in interlocking relation on the rib 45 and a second spacer 54 is mounted adjacent thereto after the portions 54*c*, 54*d* and 54*e* are first broken away from the main web 54*a***.

In order to facilitate the severance of these portions **54*c*, 54*d* and 54*e* from the main body web 54*a*, the spacers are formed with a V-shaped notch or groove 57 on the inside surface of the sloped segment 54*c* and adjacent this groove, the main body web 54*a* is provided with a transverse stiffening rib 54*f*. This unique construction permits the sloping segment 54*c* to be broken off cleanly and evenly along the outside edge of the stiffening rib 54*f* whenever a second spacer 54 is required as shown in FIG. 3. The outside edge of the rib 54*f*** then provides a spacing stop for insuring the proper alignment of a second or even a third spacer strip with the first.

Along an opposite edge of the spacer 54 there is provided an offset flange **54*g* generally parallel of the main web 54*a* and an inturned, L-shaped flange 54*h* having an inner edge adapted to abut the inside surface of a metal wall face 44*a* or 46*a*. The flange portions 54*g* and 54*h* form a groove 59 along the edge of the spacer for receiving a tongue 50*e* provided on the inside surface of the edge flange 50*b* of the cladding element. The tongue and groove interlocking arrangement between the outer edge flange 50*b* of the cladding element 50 and the outer edge portion of the spacer 54 provides a positive interlock to securely maintain the web of the cladding element 50*a* in spaced apart, parallel relation with the inside wall 44*a* or 46*a* of an outside tubular metal element 44 or 46**.

After the heat insulating spacer strips 54 are installed on the inside wall faces **44*a* and 46*a* of the door stiles and rails, the cladding strips or elements 50 are cut to length and are installed by first engaging the tongue 50*e* within the grooves 59 of the spacers as illustrated. The cladding elements are then rotated by movement of the flange 50*c* so that the intermediate tongue 50*d* engages in abutting contact with the outside edge surface of the J-shaped flange 54*e*** on a spacer strip as shown.

To limit the travel of the tongue **50*d*, the tongue is provided with an integral stop rib 50*f* of L-shaped transverse cross section, which rib moves into a stopping, hooked interengagement with an outer end portion on a rib 54*i* of the spacer. This stopping engagement insures precise parallel alignment between the inside face of the cladding element web 50*a* and the inside surface of the wall or faces 44*a* and 46*a* of the respective inside tubular metal members 44 and 46. After this seated engagement is achieved, an inner edge portion of the tongue 50*d* designated 50*g* is crimped over with a tool into a permanently deflected holding engagement with the J-shaped flange 54*e* of the spacer 54 at appropriate intervals along the length. After this crimping action as shown by the small curved arrows, the cladding element 50 is positively interlocked in place in a heat insulating relationship with the spacer 54 and with the outside tubular metal frame members 44 and 46** of the door frame.

The intermediate tongue **50*d* of the cladding strip 50 is formed with a pair of ribs 50*h* and 50*i* on an opposite side of the flange 50*d* with respect to the rib 50*f* and this pair of ribs provide a channel shaped recess for positioning and holding in place an elongated filler strip 58 which is formed of resilient, cellular plastic, foam material. The rol-like fillers 58 are cut to length and when inserted as shown seal between the tongue 50*d* and the inside edge flange 50*c*. As illustrated in FIG. 1, the opposite ends of the rails 44 and 46 are butt fitted against the walls 44*a* of the stiles, which stiles are open at the upper and lower ends. The respective cladding members 50 on the rails and stiles are similarly butt-fitted when installed in place. The filler strips 58 provide a continuous seal around the inside marginal edges of the glazing panel 34 between the outside and inside surfaces of the door so that any infiltrating air which may pass inwardly into the upper or lower ends of the hollow stiles 44 will not be permitted to pass into hollow channels formed on the inside faces of the tubular members by and between the spacers 54 and the cladding strips 50**.

Referring to FIG. 3, it will be noted that the wider cladding strip 50 on the rail 42 includes a lower face portion 50*j* which projects downwardly below the L-shaped flange 50*b* and the face portion has a lower edge positioned slightly above the lower edge of the inside wall face 46*a* of the outside metal tubular member 46. At appropriate intervals, round openings 61 are drilled in the flange portion 50*j* so that self-tapping, sheet metal screws 60 may be turned to secure and adjust the position of an elongated, bottom weather strip extrusion 62 in place along the lower edge portion of the outside tubular member 46 as shown.

The metal weather strip element is formed of an aluminum or metal extrusion with a thickened lower edge portion having a groove 63 therein for receiving in wedged engagement, an upper edge portion of an elongated strip of resilient plastic weather stripping material 64. The plastic weather stripping material has a flexible, depending lower edge portion which is deflectable and which normally seals against an upper surface 22*a* of the threshold 22 and bears against a stop surface 22*b* thereof when the door is closed. As illustrated in FIG. 3 the threshold 22 includes a sloping outside ramp portion 22*c* and a similarly sloping inside ramp portion 22*d* having parallel traction grooves in the upper surface thereof as illustrated. A centrally positioned, vertical stiffening rib 22*e* if formed at the juncture of inside ramp and the main web portion 22*a*.

The insulating spacers 54 and the inside metal cladding elements 50 may be installed on existing, non insulating types of doors having stiles and rails with tubular transverse cross sections as illustrated. In the conversion of a non-insulating type door having only a single thickness glazing panel, the glass panel is first removed by removing the usual outside glazing stops and then applying the new insulating spacing strips 54 and the inside metal cladding member 50 as previously described. After this installation is completed, the filler rods 58 are inserted in place and inside glazing strips 52 are cut to length and installed in the grooves 51 of cladding members 50. A new, heat insulating glazing panel 34 having dual, spaced apart glass panes is then mounted into place in the insulated door frame.

The new dual pane glazing panel is supported on a setting block 147 mounted on the upper wall 46*b* of the lower rail 46 and positioned approximately one-fourth of the width of the glass panel from the pivot stile. Similarly, a setting block is provided between the pivot stile and the glass panel near the bottom rail and between the lock stile and the glass panel near the top rail. Another block is provided between the top rail and the glass panel near the pivot stile to complete the blocking as described in the aforementioned U.S. Pat. No. 2,610,369. The dead load of the panel is transferred to the lower rail of the frame and is eventually transferred to the hinges 14 through the corner connection of the lower rail and the hinge stile 36.

Completion of the glazing process for the new dual pane panel 34 is accomplished with the installation of elongated glazing stops 66. These stops have an outwardly facing leg 66*a* with a groove on the inside surface thereof for supporting in keyed engagement therewith an outside, resilient glazing strip 52. The glazing stops 66 are generally L-shaped in transverse cross section and include an inwardly directed flange or leg 66*b* which includes an edge portion that is secured under the annular lip of pie-pan shaped fastening buttons 68. These buttons are mounted at spaced intervals on the transverse walls 44*b* and 46*b* of the stiles and rails of the door frame with self-tapping, sheet metal screws 70.

At the corner or junction between the leg 66*a* and the leg 66*b*, the glazing stops 66 are formed with a V-shaped groove 67 for accommodating the trapezoidal shaped ribs 45 along the edges of the outside walls 44*c* and 46*c* of the metal door frame members. Engagement between the groove 67 of the glazing stop 66 and the rib 45 of the frame members along with the engagement of the inner edge of the inwardly directing leg 66*b* beneath the outer lip of the circular glazing buttons 68 provides a positive means of securing the glazing panels 34 in place in the door frame. A weather-tight seal is formed around the peripheral margin of the panel by the resilient sealing strips 52.

The insulated door 12 has greatly improved heat insulating characteristics in comparison to conventional door utilizing only solid metal frame elements and a single thickness glazing panel. Moreover, the conversion of an existing non-insulated door to a heat insulating type in the manner shown and described is a cost efficient means of improving the thermal efficiency of a building entrance.

Preferably the heat insulating door 12 is used in conjunction with heat insulating type jamb members framed around the entrance opening to provide excellent overall thermal characteristics for the entrance system and building wall. The vertical jamb members or mullions 16 and 18 which form jamb surfaces of the door opening along with the header 32 above the door may comprise heat insulating type structural sections having a hollow tubular inner metal member 72 formed of extruded aluminum or the like and provided with an outwardly facing pocket portion 72*a* which is filled with a heat insulating type resinous material 74. A suitable mullion member is shown and described in a copending U.S. patent application, Ser. No. 880,710, filed Feb. 28, 1978, and assigned to the same assignee as this application. The resin embeds and supports a T-shaped metal tongue 76*a* extending inwardly into the pocket and forming a central rib of an outside metal member 76 of generally T-shaped transverse cross section. This type of heat insulating structural member is strong enough to provide support for a hinged door mounted to swing thereon.

As illustrated in FIG. 2, the member 72 forms a glazing pocket for receiving the marginal edge of a glazing panel 26 or 32 of the building or curtain wall structure. When a heat insulating structural member of the type shown is to be used as a jamb member around a door or window opening, a filler element 80 of generally L-shaped cross section is installed into place as shown. The element includes a rib on an inturned leg aa thereof secured to the tongue portion 76*a* by self-tapping fasteners 82 provided at appropriate intervals along the length.

It should be noted that the inturned flange portion 80*a* is maintained in spaced apart relation from the adjacent outwardly facing portion of the inside metal element 72 in order to preserve a continuous heat insulating relationship or thermal barrier between the inside and outside metal elements of the jamb. In addition, the spacing between these portions provides a slot for the base portion 84*a* of a flexible, weather sealing strip 84 which is formed of extruded resilient plastic material and which includes an outwardly extending sealing lip 84*b* adapted to bear against the flange portion 50*b* on the cladding element 50 on the door. The weatherstrip 84 is preferably of the general type as shown and described in U.S. Pat. No. 4,147,634, which patent is assigned to the same assignee as the present application.

In order to provide a relatively smooth seal and transition between the face of the wall surfaces 44*d* and 46*d* of the outside metal hollow tubular elements of the door frame and the flanges 50*b* of the cladding elements 50, a strip of gunned-in-place sealant or caulking material 86 is extruded into the space or area between the rounded corners of the door frame members 44 and 45 and the cladding flanges. This sealant material also insures that the tongue 50*e* of a cladding strip 50 does not become dislodged from an interlocking engaged relationship within the groove 59 of the supporting insulating spacer strip 54. Further weather sealing and a stop for the door is provided by a door stop 88 of generally L-shaped transverse cross section having one leg secured to the jamp surface of the inside metal member 72 of the mullion by a plurality of screw fasteners 90 at appropriate intervals therealong. The door stop includes a groove facing outwardly in which is seated a base portion of a resilient door sealing strip 92 adapted to seal and abut against the inside face of the web 50*a* on the cladding members 50 when the door is closed.

The header 20 comprises an insulating type frame member generally similar to the mullion members 16 and 18 and including a hollow tubular inner metal member 94 secured in place at opposite ends between jamb surfaces of the mullion members by channel shaped mounting brackets 96 and screw fasteners 98. The member 94 includes an outwardly facing pocket 49*a* filled with heat insulating resinous plastic material 100 to support a T-shaped member 102 extending horizontally outward of the pocket. The member 102 is formed with a vertically extending flange 102*a* along an outer edge for interlocking engagement with a tongue 104*a* of a removable mullion face member 104. The face member includes a vertical outer wall 104*b*, a horizontal lower jamb wall 104*c* and a relatively thick inner flange 104*d* which is pin connected to the brackets 96 at opposite ends by headed pins 106 when the mullion face member is installed in place.

An L-shaped door stop 108 is mounted on the lower wall of the tubular member 94 and the stop includes a grooved vertical element for supporting the base of a weatherstrip 84. A thin wall stop cover 110 is snapped into place on the L-shaped stop 108 as shown to provide a more finished appearance along the header.

It will be seen from FIGS. 2, 3 and 4 that the insulated entrance system 10 provides a continuous heat insulating, spaced relation between the outside metal elements of both the door and surrounding jamb or building wall frame and the inside metal elements thereof so that a permanent and continuous heat insulating barrier or thermal break is formed with no heat or thermal short circuits permitted between the metal elements. Moreover, the door 12 has excellent thermal insulating characteristics and excellent air sealing is provided around the entire periphery thereof and the adjacent jamb surfaces of the opening.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A cladded, insulated frame member assembly for buildings comprising:

an elongated frame member of metal having a wall face with a rib along one edge;

a spacer formed of heat insulating material including hook means along one edge in interengaged, hooked relation with said rib and having an opposite edge; and an elongated metal cladding element having hook means along one edge in interengaged, hooked relation with said opposite edge of said spacer and having a rib element with a deformable portion adapted to be deformed into holding engagement with said one edge of said spacer for securing said cladding element in the assembly, said rib element positioned between opposite outer edges of said cladding element and including a deflectable rib for providing said holding engagement with said spacer hook means on said rib of said frame member, said cladding element including an opposite edge portion projecting beyond said rib element away from said frame member, said opposite edge portion of said cladding element including means for supporting one face of an edge portion of a panel supported by said frame member assembly, said opposite edge portion of said cladding element including a flange parallel and spaced apart from said rib, and filler means inserted between said flange and rib.

2. The cladded insulated frame member assembly of claim 1 wherein said hook means along said one edge of said spacer includes a groove for receiving said rib of said frame member.

3. The cladded insulated frame member assembly of claim 1 wherein said opposite edge of said spacer includes a groove spaced from said wall face for receiving said hook means of said cladding element.

4. The cladded, insulated frame member assembly of claim 1 wherein said frame member includes an opposite wall face and a rib thereon opposite said first mentioned rib and an elongated glazing element engageable with said rib of said opposite wall face and confronting an opposite face of an edge portion of said panel carried by said frame member assembly.

5. The cladded, insulated frame member assembly of claim 4 including a pair of resilient, elongated glazing strips engaging opposite faces of said panel and secured between said panel and said cladding means and said panel and said glazing element, respectively.

6. The cladded, insulated frame member assembly of claim 4 wherein said frame member includes a transverse wall segment joining said wall faces thereof adjacent an edge of said panel and means for securing said glazing element adjacent said wall segment for holding said panel in place.

7. The cladded, insulated frame member assembly of claim 6 wherein said glazing element includes a flange for engaging said securing means and said rib of said opposite wall face of said frame member.

8. The cladded, insulated frame member assembly of claim 7 including setting block means for supporting an edge of said panel from said wall segment of said frame member between said glazing element and said cladding element.

9. The cladded insulated frame assembly of claim 1 wherein said filler means comprises an elongated strip of compressible insulated material.

10. The cladded insulated frame member assembly of claim 9 wherein said filler means adhesively interconnects said one edge of said cladding element and said wall face of said frame member.

11. The cladded insulated frame member assembly of claim 9 wherein said filler means forms a seal between said one edge of said cladding element and said wall face of said frame member.

12. The cladded insulated frame assembly of claim 1 wherein said strip is formed of cellular foam material.

13. The cladded insulated frame member assembly of claim 1 wherein said filler means comprises a bead of gunned-in-place caulking material.

14. The cladded insulated frame member of claim 13 wherein said spacer includes a backing member extending between said one edge of said cladding element and said wall face of said frame member for supporting an inside surface of said caulking material.

15. The cladded insulated frame member assembly of claim 1 wherein said spacer is formed with a groove in a body portion spaced inwardly and parallel of said one edge for facilitating the breaking off of said hook means therefrom.

16. The cladded insulated frame member assembly of claim 15 wherein said spacer includes a flange adjacent an inner edge of said groove forming a stop for abutting an opposite edge of a second of said spacers secured on said frame member adjacent thereto, said cladding rib element mounted in deformed engagement with said one edge of said second spacer.

17. A building wall construction including a fixed wall portion defining an opening and a movable closure member adapted to open and close with respect to said opening;

said fixed wall portion including an elongated wall frame member along one edge of said opening including an inside metal element, an outside metal element and a heat insulating element interconnecting said metal elements;

said movable closure member including an elongated frame member assembly comprising;

an elongated outside frame member of metal having an inside wall face with a rib along one edge, a spacer of heat insulating material including hook means along one edge for interengaged, hooked relation with said rib and an opposite edge, and an elongated inside frame member of metal having hook means along one edge for interengaged, hooked relation with said opposite edge of said spacer and having a rib element with a deformable portion adapted for deformed holding engagement with said one edge of said spacer for securing said cladding element in the assembly, said rib element positioned between opposite outer edges of said cladding element and including a deflectable rib for providing said holding engagement with said spacer hook means on said rib of said frame member, said cladding element including an opposite edge portion projecting beyond said rib element away from said frame member, said opposite edge portion of said cladding element includes means for supporting one face of an edge portion of a panel supported by said frame member assembly, said opposite edge portion of said cladding element including a flange parallel and spaced apart from said rib, and filler means inserted between said flange and rib.

18. The wall construction of claim 17 wherein said wall frame member comprises a jamb member and said closure member comprises a door/window, a stop supported from said jamb member for limiting relative movement of said door/window when said door/window closure member is adjacent said stop.

19. The wall construction of claim 18 wherein said stop is supported from said inside metal element of said jamb member and includes a sealant strip of resilient material engageable with said inside frame member of said door/window when closed along a line inside of said weatherstrip means.

20. The wall construction of claim 18 wherein said inside and outside metal elements include spaced apart facing portions on jamb segments thereof and said weatherstrip means includes a face portion secured between said facing portions and an outer portion for sealing engagement with said door/window when closed.

21. A door/window comprising:

an elongated, tubular metal frame member including an inside wall and an integral wall transverse thereto with a rib formed adjacent a corner formed by said walls;

an elongated cladding member of metal having a channel shaped transverse cross-section with a web forming an inside wall face of said door/window and a pair of edge flanges transverse thereto; and a spacer of heat insulating material between said inside wall face and said inside wall for maintaining said members in heat insulating spaced apart relation, said spacer including hook means along one edge in interengaged hooked relation with said rib, and having a channel shaped transverse cross-section comprising a web in spaced apart relation with said web of said cladding member and said inside wall of said tubular frame member, and a pair of edge flanges of said spacer formed along opposite edges of said web, one of said flanges of said cladding member in supported engagement with an edge of said spacer remote from said one edge and said one edge of said spacer in supported engagement with said rib of said tubular frame member, said cladding member including a rib element deformable into holding engagement with said one edge of said spacer for securing said cladding element in heat insulating relation on said frame member of said door.

22. The door/window of claim 21 wherein said cladding member includes an intermediate flange between said edge flanges integral with said web, said intermediate flange having an outer edge in supported engagement with said opposite edge of said spacer.

23. The door/window of claim 21 wherein one of said edge flanges of said spacer is in supportive engagement with said one edge flange of said cladding member and includes an outer edge in abutting engagement with said inside wall of said tubular frame element.

24. The door/window of claim 23 wherein said one edge flange of said cladding member includes a rib along an inside surface extended toward an opposite edge flange of said member and supportively engaged within a groove defined in said one edge flange of said spacer.

25. The door/window of claim 23 or 24 wherein the other edge flange of said spacer has a groove on an inside surface thereof for receiving said rib of said tubular frame member in interlocking relation therewith.

26. The door/window of claim 25 wherein said cladding member includes an intermediate flange between said edge flanges thereof and abutting an outer surface of said other edge flange of said spacer in supported relation therewith.

27. The door/window of claim 26 wherein said intermediate flange has an outer edge portion adapted to be deformed against an outer edge of said other edge flange of said spacer.

28. A method of cladding one side of an elongated frame member having a wall face with a rib along one edge, comprising the steps of:

securing a spacer formed of heat insulating material onto said wall face by hooking one edge of said spacer over said rib and applying one or more fasteners between said spacer and said wall face at a position spaced remote from said one edge;

securing an elongated cladding element to said spacer in spaced apart relationship with said wall face by hooking one edge of said element over an edge of said spacer opposite said one edge thereof and deflecting a rib of said element into hooked engagement with said one edge of said spacer at appropriate intervals spaced along the length of said frame member and said cladding element, and securing a second spacer adjacent said first mentioned spacer by abutting a gauging element thereof against an opposite edge of said first mentioned spacer and applying one or more fasteners between said second spacer and said wall face remote from said opposite edge wherein said elongated cladding element has said one edge hooked in engagement with said opposite edge of said second spacer.

29. The method of claim 28 including the step of applying a filler between said one edge of said cladding element and said frame member.

30. The method of claim 28 or 29 including the step of inserting a filler between said rib and an opposite edge portion of said cladding element.

* * * * *